US005476255A

United States Patent [19]

Murcko et al.

[11] Patent Number: 5,476,255

[45] Date of Patent: Dec. 19, 1995

[54] MECHANISM AND METHOD FOR FEEDING SHEETS FROM A STACK

[75] Inventors: David Murcko, Sandy Hook; William A. Salancy, Norwalk; Morton Silverberg, Westport; Bret K. Taylor, Bethel, all of Conn.

[73] Assignee: Pitney Bowes Inc., Stamford, Conn.

[21] Appl. No.: 70,005

[22] Filed: May 28, 1993

Related U.S. Application Data

[63] Continuation of Ser. No. 752,920, Aug. 29, 1991, abandoned, which is a continuation of Ser. No. 492,035, Mar. 12, 1990, abandoned.

[51] Int. Cl.[6] ..... B65H 3/06; B41F 13/56

[52] U.S. Cl. ..... 271/109; 271/121; 271/161

[58] Field of Search ..... 271/10, 21, 22, 271/121, 124, 167

[56] References Cited

U.S. PATENT DOCUMENTS

| | | | |
|---|---|---|---|
| 3,771,783 | 11/1973 | McInerny | 271/125 |
| 4,232,860 | 11/1980 | Brown | 271/119 |
| 4,288,068 | 9/1981 | Hushimoto et al. | 271/125 |
| 4,436,298 | 3/1984 | Donner et al. | 271/10 |
| 4,461,466 | 7/1984 | Uchida et al. | 271/124 X |
| 4,526,358 | 7/1985 | Ura et al. | 271/34 |
| 4,535,981 | 8/1985 | Watanabe et al. | 271/124 X |
| 4,560,154 | 12/1985 | Nogi et al. | 271/10 |
| 4,589,650 | 5/1986 | Miyoshi | 271/242 |
| 4,674,736 | 6/1987 | Tsubo | 271/122 |
| 4,705,265 | 10/1987 | Hirota et al. | 271/122 |
| 4,861,013 | 7/1989 | Shibata et al. | 271/119 |
| 4,958,825 | 9/1990 | Onomoto et al. | 271/121 X |

FOREIGN PATENT DOCUMENTS

| | | | |
|---|---|---|---|
| 398299 | 11/1990 | European Pat. Off. | 271/121 |
| 152736 | 9/1983 | Japan | 271/121 |
| 48342 | 3/1984 | Japan | 271/121 |
| 97142 | 5/1985 | Japan | 271/121 |
| 244733 | 12/1985 | Japan | 271/121 |
| 71044 | 3/1988 | Japan | 271/121 |
| 117142 | 5/1989 | Japan | 271/121 |
| 178139 | 7/1990 | Japan | 271/121 |

*Primary Examiner*—William E. Terrell
*Assistant Examiner*—Luong Nguyen
*Attorney, Agent, or Firm*—Robert H. Whisker; Melvin J. Scolnick

[57] ABSTRACT

As apparatus for producing items in selected configurations and a system and method for controlling the same. The apparatus includes a laser printer and folding sealing apparatus controlled by a data processor. The folder sealer apparatus combines sheets printed by the laser printer with pre-printed sheets and envelope forms, which also may be printed by the laser printer. The apparatus folds the sheets as necessary and folds and seals the envelope form about the folded sheets to produce a mail piece. A user inputs a configuration for the mail piece which is translated by the data processor and transmitted to the controller of the folder sealer apparatus. The controller controls the laser printer and the folder sealer to produce the mail piece in the defined configuration. Concurrently the data processor transmits text from an output file to the laser printer for printing on printed sheets and envelope forms. The data processor also controls the laser printer to print an address for the mail piece. Thus the apparatus is controlled to process an output file into a mail run. A sheet feeder for feeding sheets and envelope forms to the apparatus is also disclosed. The sheet feeder includes a take-up mechanism and a separating mechanism for singulating sheets. The separating mechanism includes a pair of crown rollers positioned above and between a pair of fixed, quarter-round retarding elements which extend in the feed direction. A top sheet is corrugated sufficiently that drag forces between it and a next sheet are reduced. A plate is positioned downstream from the separating mechanism to decorrugating the top sheet.

6 Claims, 6 Drawing Sheets

MECHANISM AND METHOD FOR FEEDING SHEETS FROM A STACK

RELATED APPLICATIONS

This application is a continuation of application Ser. No. 07/752,920 filed Aug. 29, 1991, now abandoned; which is a continuation of application Ser. No. 07/492,035, filed Mar. 12, 1990, now abandoned.

The subject application is one of the following group of commonly assigned patent applications, all filed on even date herewith, all of which relate to a particular development effort conducted for the assignee of the subject application and which share common elements of disclosure.

| | | |
|---|---|---|
| Ser. No. 162,360 | Envelope Form For Preparing a Multi-Sheet Mail Piece | (C-624) |
| Ser. No. 163,596 | System and Method for Controlling an Apparatus to Produce Mail Pieces in Non-Standard Configurations | (C-625) |
| Ser. No. 181,935 | System and Method for Controlling an Apparatus to Produce Mail Pieces in Selected Configurations | (C-626) |
| Ser. No. 168,931 | System and Method for Producing Items in Selected Configurations | (C-631) |
| Ser. No. 165,998 | Mechanism and Method for Accumulating and Folding Sheets | (C-632) |
| Ser. No. 167,518 | Flap Opening Mechanism and Method | (C-633) |
| Ser. No. 167,517 | Mechanism and Method for Folding Folding and Sealing the Upper and Side Flaps of an Envelope Form | (C-634) |
| Ser. No. 170,390 | Mechanism and Method for Laterally Aligning an Accumulation of Sheets | (C-635) |
| Ser. No. 192,790 | Sheet Feeder | (C-636) |

BACKGROUND OF THE INVENTION

This invention relates to the production of mail pieces in a variety of configurations. More particularly, it relates to a sheet feeder for an apparatus and process which produces mail pieces in a selected one of a plurality of possible configurations.

Self-mailers are mail pieces which are produced from pre-cut forms which are folded and sealed to form a mail piece, and are well known, as is apparatus for printing and forming such self-mailers. Commonly assigned, co-pending U.S. application Ser. No. 407,583, to: Samuel W. Martin, filed Sep. 14, 1989 (C-574) discloses one such self-mailer wherein a pre-cut form is printed on a laser printer, or similar computer output printer, and fed to a folding and sealing apparatus to produce a self-mailer. Similarly, U.S. Pat. No. 3,995,808 to: Kehoe, issued Sep. 7, 1976 discloses another self-mailer wherein a web of forms is printed, folded longitudinally and sealed, and separated to form individual self-mailers. U.S. Pat. No. 4,063,398 to: Huffman, issued: Dec. 20, 1977 discloses another self-mailer wherein a web of forms is folded transversely to produce self-mailers. Huffman also provides for insertion of preprinted piece or "stuffers".

In general self-mailers as taught by the prior art are useful as a means of generating large numbers of mail pieces, but are limited in that they can be formed into only a small number of configurations. (By configurations, as applied to mail pieces herein, is meant variations such as use of a windowed or a printed envelope, variations in the number and type of printed pages, and variations in the number and type of pre-printed inserts.) At most, like Huffman they may provide for an ability to insert "stuffers". Further, with the exception of the above mentioned U.S. application Ser. No. 407,583 the equipment for producing such self-mailers has generally been physically large and suitable only for use in environments such as large computing centers.

Where it has been necessary to provide greater flexibility in the configuration of a mail piece which may be produced the solutions taught by the prior art have generally involved the use of inserters. An inserter is a transport system having a plurality of stations and along which a "control document" is transported from station to station. At selected stations pre-printed inserts may be accumulated with the control document and at the last station the entire accumulation is inserted in a pre-formed envelope. A typical use of such inserter systems would be by a bank mailing monthly statements to its customers, where the control document would be individual statements printed on the bank mainframe computer and the inserts would include each individual's cancelled checks. Such inserter systems are described, for example, in U.S. Pat. No. 3,935,429; to: Branecky et al. for: Process and Apparatus for Controlling Document Feeding Machines; From Indicia Contained on a Document Fed Therefrom; issued: Jan. 27, 1976.

Inserters do provide a high degree of flexibility in producing mail pieces in a number of configurations, and have proven very satisfactory for users such as banks and credit card companies. However, they suffer also from major limitations. First, because inserter systems generally do not operate under the control of the computer which prints the control document, a very significant problem exists in assuring that the proper inserts are matched with the correct control document. Because of this difficulty it has generally been necessary to use window envelopes with inserter systems rather than printed envelopes, so that an address pre-printed on the control document could be used to deliver the mail piece. Finally, inserters, like equipment for producing self-mailers, are generally quite physically large and suitable for use only in a large computer operation or production mail room.

Another approach to the problem of producing mail pieces was developed by Pitney Bowes Inc., assignee of the subject invention, under contract with the U.S.P.S. This equipment, known as PPHE (for Printing and Paper Handling Equipment) printed a continuous web, collated and separated the web to form sheets, folded the collated sheets longitudinally, and wrapped an envelope form around the wrapped sheets. The PPHE had a capability to add "stuffers" to a mail piece and was intended for production applications only, as the equipment was tens of feet long. The PPHE lacked capability to print envelope forms or handle variable length sheets.

A particular problem which arises in apparatus for the production of mail piece, and particularly where such apparatus is intended for an office environment, is the need to provide reliable sheet feeding for a variety of diverse paper sizes and weights. This problem is increased in apparatus which is intended to handle pre-printed sheets, where the pre-printed sheets may be printed on any of several different types of stock.

Thus it is an object of the subject invention to provide a sheet feeder mechanism which is capable of handling diverse sizes and weights of sheets.

It is another object of the subject invention to provide such a sheet feeder mechanism which occupies a small volume and is suitable for use with apparatus intended for the office environment.

BRIEF SUMMARY OF THE INVENTION

The above objects are achieved and the disadvantages of the prior art are overcome in accordance with the subject invention by means of a mechanism for feeding sheets from a stack which include a low force feed device for urging the top sheet of the stack forward, and a combined device for receiving the top sheet, corrugating the top sheet, singulating the top sheet from a following sheet which may have adhered to the top sheet and feeding the top sheet forward for further processing.

In accordance with one aspect of the subject invention the combined device further includes a pair of spaced feed rollers positioned to bear against the top surface of the top sheet after it is received from the low force feed device, and a pair of spaced retarding elements positioned to bear against the bottom surface of the following sheets if such a following sheet has adhered to the top sheet.

In accordance with another aspect of the subject invention the feed rollers exert a force downwards and outwards against the top sheet, depressing the top sheet between the retarding surfaces so that the top sheet is corrugated away from any following sheet which may have adhered.

In accordance with still another aspect of the subject invention the retarding surfaces are mounted a four bar linkage allowing the retarding surfaces to be displaced downwards while maintaining a constant orientation with respect to the feed rollers thus allowing sheets of varying thickness to be fed without jamming.

In accordance with still another aspect of the subject invention a guide for smoothing the leading edge of the top sheet as it emerges from the feed rollers is positioned close to the feed rollers to smooth the leading edge while the sheet is still engaged by the feed rollers and retarding surfaces, thus allowing the top sheet to be easily deflected upwards or downwards while the sheet is still engaged by the feed rollers and retarding surfaces.

Thus it can be seen that the subject invention advantageously achieves the above objects. Other embodiments and advantages of the subject invention will be readily apparent to those skilled in the art from consideration of the attached drawings and the Detailed Description set forth below.

BRIEF DESCRIPTIONS OF THE DRAWINGS

DETAILED DESCRIPTION OF PREFERRED EMBODIMENTS OF THE SUBJECT INVENTION

Figure 1:
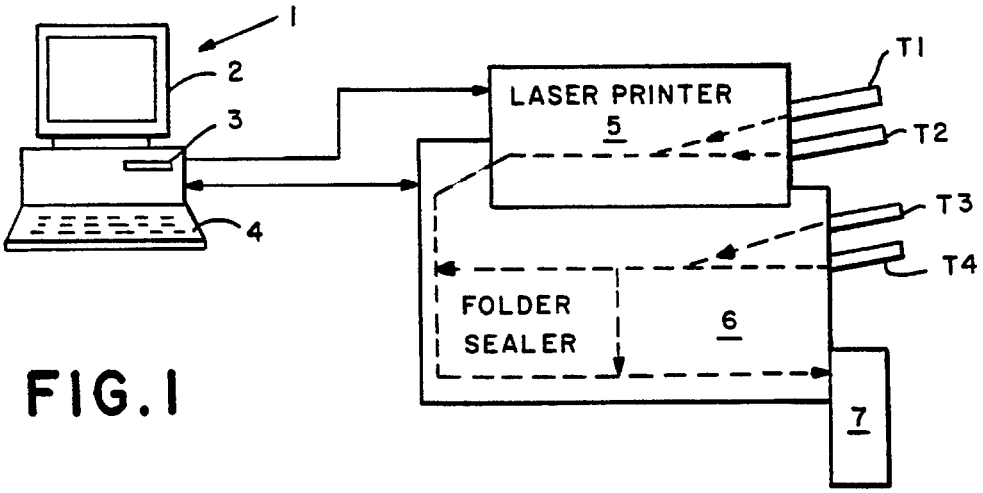
FIG. 1 shows a schematic block diagram of apparatus in which the mechanism of the subject invention may be used.

FIG. 1 shows a system for producing mail pieces and with which the sheet feeder of the subject invention may be used. The system includes a personal computer 1 including a monitor 2, a hard disk 3 with at least one megabyte of available storage 3, and a keyboard 4. Computer 1 also requires a minimum of 640K of RAM memory in the subject invention. Optionally a computer "mouse" (not shown) may be provided for operator input. Computer 1 communicates with laser printer 5 through a conventional parallel interface which is preferably the well known Centronix interface. Preferably, Laser printer 5 is a commercially available Laser printer such as those marketed by the Hewlett Packard Corporation under the trademark "Laser Jet". Other printers, including ink jet and impact printers, may also may be used in the subject invention.

Laser printer 5 includes conventional trays T1 and T2 from which sheets are fed to laser printer 5 for printing, as will be described further below. Tray T1 may be used for envelope forms, and tray T2 may be used for either three-thirds sheets or two-thirds sheets.

Laser printer 5 is mounted on, and physically connected to, folder sealer 6 so that, after printing, sheets are passed from laser printer 5 to folder sealer 6 where they are accumulated with an envelope form, folded and sealed, and output to stacker 7. Folder sealer 6 also includes trays T3 and T4 which may be used to add pre-printed sheets to the mail piece. Tray T3 and tray T4 may be used to supply either three-thirds, two-thirds, or one-thirds length pre-printed sheets or pre-printed business reply envelopes (BRE's) to be added to the mail pieces. Tray T3 may also be used to provide a window envelope form so that the address of the mail piece may be printed on a printed sheet rather than a separate (non-window) envelope form. Because of the diversity of types of preprinted sheets, which may be printed on a broad range of stock, the subject invention provides a novel sheet feeder, which includes a corrugating feeder mechanism, 114 for tray T3 and 118 for tray T4, which provides reliable sheet feeding performance in a limited space, as will be described further below.

Those skilled in the art will readily appreciate that the system shown in FIG. 1 provides an almost limitless ability to produce mail pieces having a selected configuration. In a preferred embodiment of the subject invention the allowable combinations are limited by the following rules:

1. Each feeder tray: T1, T2, T3, T4 will have homogenous stock.

2. Each mail piece will include exactly one envelope.

3. Each mail piece will include at least one non-envelope.

4. Each mail piece having a window envelope, will include at least one printed sheet.

5. For each mail piece a feeder will supply no more than two one-third sized sheets.

6. Each mail piece will include no more than one BRE.

7. Because of the practical limitations on folding ability each mail piece will include no more than a total of three two-thirds size or three three-thirds size sheets.

8. Because of the practical limitations on envelope thickness each mail piece will be no more than twelve sheets thick, where BRE's are considered to be two sheets thick.

Figure 2:
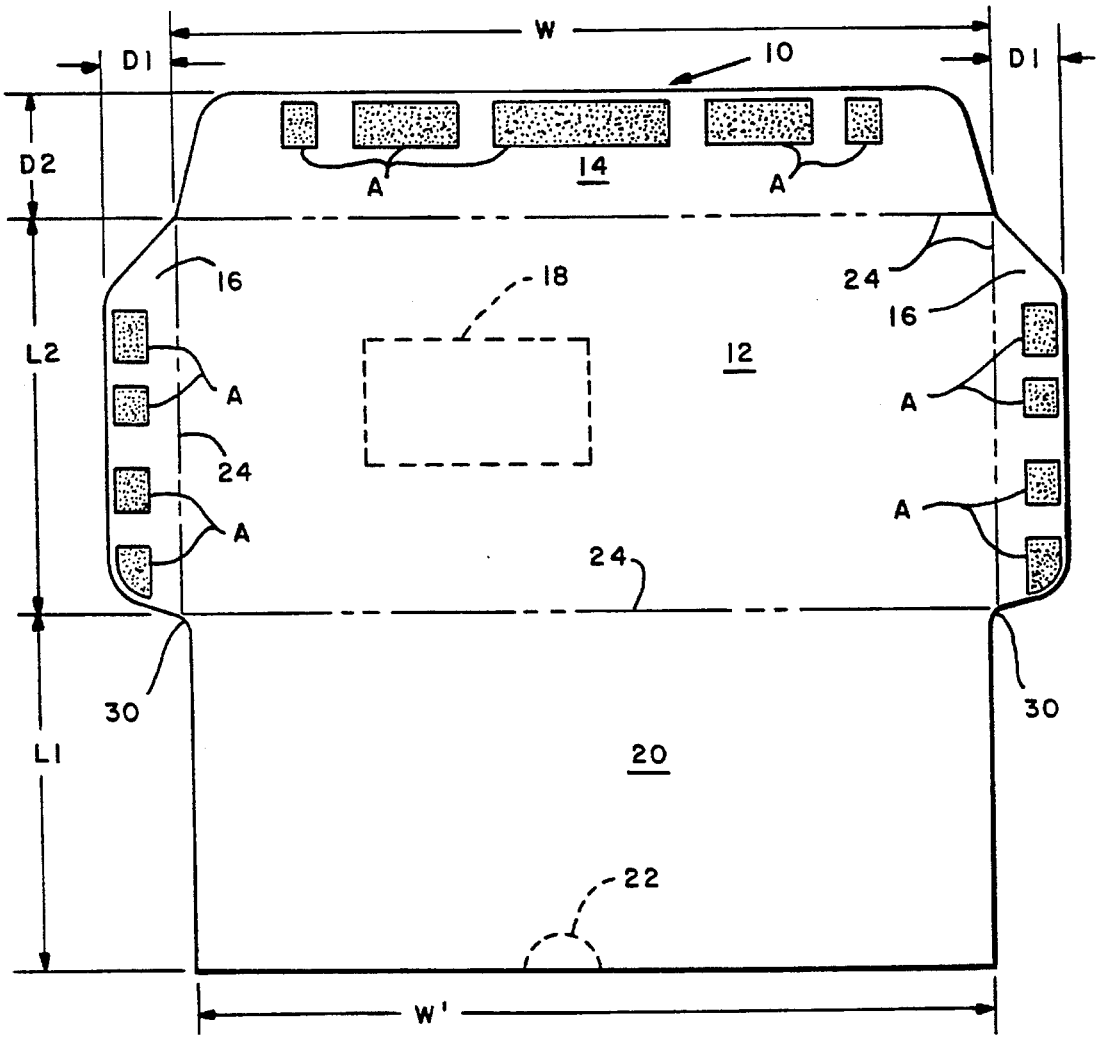
FIG. 2 shows a plan view of an envelope form suitable for use with the apparatus of FIG. 1.

FIG. 2 shows a unique envelope form, which is designed to function optimally with the apparatus of the FIG. 1. Form 10 includes upper panel 12 having an upper (or trailing) flap 14 and a pair of side flaps 16. Panel 12 may also be provided with a window 18 so that the mail piece formed when form 10 is folded and sealed may be delivered to an address printed on a sheet in the mail piece. An adhesive A is applied to flaps 14 and 16 to provide for sealing of form 10 to form an envelope. Preferably adhesive A is applied to flaps 14 and 16 as spaced stripes or spots so that form 10 may be driven through the apparatus of the subject invention by segmented rollers contacting form 10 in the spaces between the stripes or spots of adhesive A and, also, to reduce curling of the form. Adhesive A is preferably a remoistenable adhesive (such as 0.0006 to 0.001 inches of dextrin/resin adhesive) which is moistened for sealing as will be described further below, but the use of self-adhesive or other suitable methods of sealing is within the contemplation of the subject invention. Flaps 14 and 16 are attached to upper portion 12, as is a rectangular lower portion 20, along preformed fold lines 24, which are preferably pre-creased to facilitate uniform folding.

To form a mail piece, sheets, which may be three thirds, two-thirds, or one-thirds sheets or BRE's, are accumulated with form 10, and form 10, together with the accumulated sheets, is folded about a fold line 24 so that the accumulated sheets are enclosed between panels 12 and 20. Adhesive A is moistened, and after folding of panels 12 and 20 and the accumulated sheets, flaps 16 are folded inwards about fold lines 24 and flap 14 is than folded downwards about fold lines 24, and the resulting mail piece is sealed.

Note that three-thirds length sheets are prefolded to two-thirds length so that the resulting mail piece is approximately one-third the length of a three-thirds sheet.

Form 10 also may be provided with expansion fold lines parallel to and outwards of lines 24 to allow for mail pieces having a maximum thickness and lower panel 20 may be provided with a notch 22 to facilitate removal of the sheets when the mail piece is opened.

For a standard 8½×11 size three-thirds sheet the following approximate dimensions have been found to be satisfactory for form 10.

D1=0.75 inches

D2=1.31 inches

L1=3.75 inches

L2=4.13 inches

W=8.70 inches

W'=8.50 inches

Figure 3:
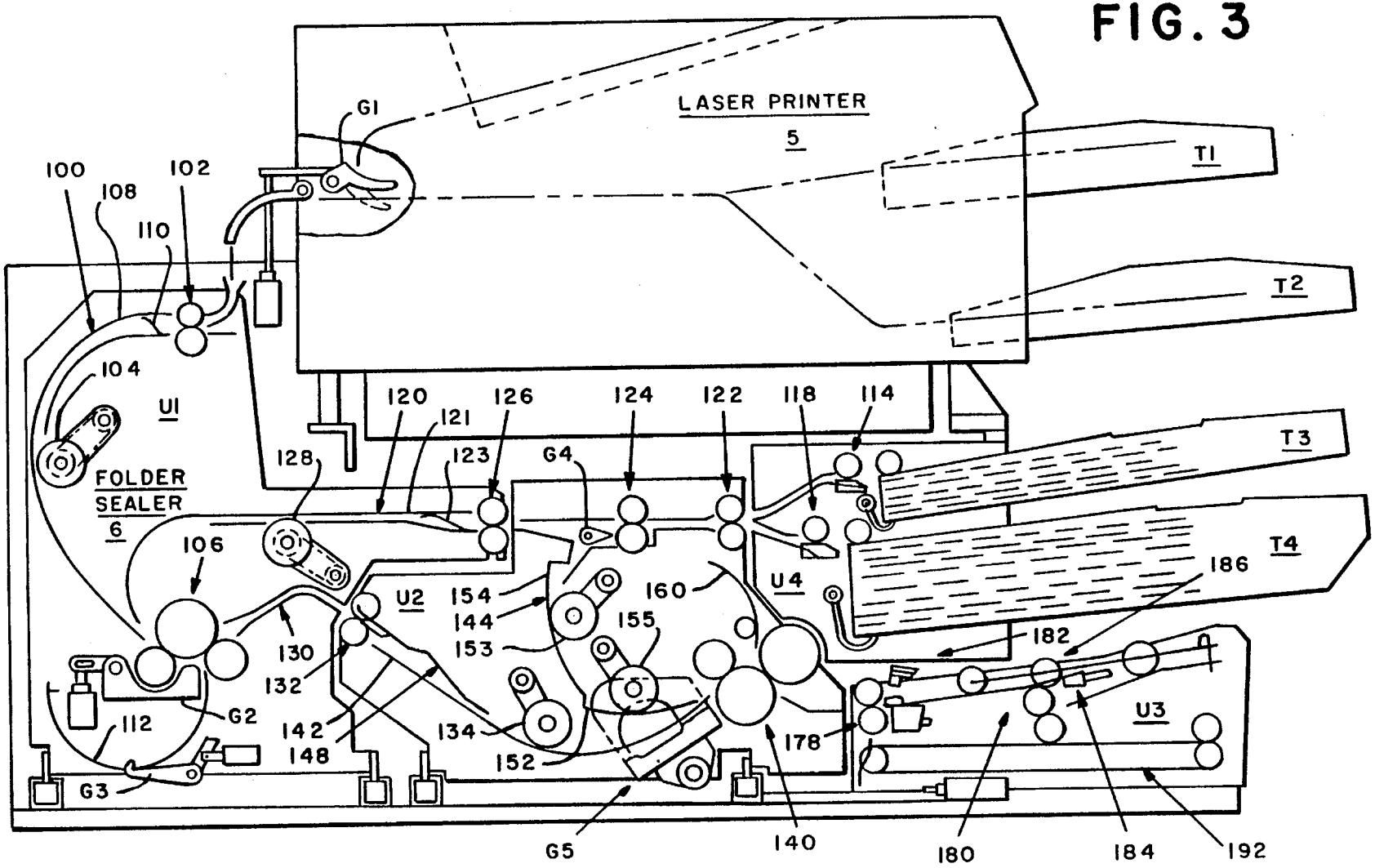
FIG. 3 shows a semi-schematic side view of a printer and a folder sealer apparatus in which the mechanism of the subject invention may be used.

Turning now to FIG. 3 a semi-schematic side view of folder sealer 6 is shown. As a printed envelope form 10 or a printed sheet exit laser printer 5 it is driven along guides 100 by roller pair 102 and and urged into the nip of accumulator folder assembly 106 by urge roller 104. (As used herein a sheet is "urged" when it is moved by an "urge roller" constructed to slip (or stall) on the sheet before the sheet buckles under the load. This contrasts with sheets which are driven by a roller pair in a positive manner, substantially without slipping.) Normally the first item will be an envelope form 10 and gate G2 will be in the activated (closed) state diverting form 10 for further processing as will be described further below. Normally following items will be printed sheets and motor M1 (shown in FIG. 6), which drives folder accumulator assembly 106 will be stopped and the sheets will be urged into the nip of assembly 106 by urge roller 104, which will continue to rotate. Because guide 100 is curved to increase the stiffness of the sheets roller 104 will slip on the sheet as it is urged into the nip of assembly 106 before the sheets will buckle. Relief 108 is provided in guide 100 so that the tail of any three-thirds sheet is held clear of roller pair 102 so that following printed sheets may pass over the first sheet and be accumulated in the nip of assembly 106.

If the sheets accumulated in the nip of assembly 106 include a three-thirds sheet gate G2 is deactivated (open) and motor M1 is started and the accumulated sheets are driven into curved, open, one sided buckle chute 112. The assembled sheets are folded by assembly 106 to a two-thirds length and exit assembly 106 for further accumulation with the previously passed form 10. Gate G3 may be activated for a "Z" fold (normally used with a window envelope); as will be described further below.

Alternatively a windowed envelope or pre-printed sheets, of three-thirds length, may be fed from trays T3 or T4 by corrugating feeder mechanisms 114 or 118 and, with gate G4 deactivated, driven along curved guides 120 by roller pairs 122, 124, and 126 and the urged by urge roller 128 for processing by accumulator folder assembly 106 in the same manner as described above for printed envelope forms 10 and printed sheets.

If the sheets accumulated in the nip of assembly 106 are all two-thirds length the assembled sheets exit assembly 106 along guide 130 without folding.

The previously processed form 10, .followed by the assembled sheets, is moved along guides 130 by roller pair 132 and urge roller 134 until it is urged into the nip of accumulator folder assembly 140. Motor M2, which drives assembly 140 is off and the leading edge of the accumulated sheets is aligned with the edge of lower panel 20 of form 10 in the nip of assembly 140. In the same manner as previously described guides 130 are curved to increase the stiffness of form 10 and the accumulated sheets. Relief 142 operates as described above so that the accumulated sheets will clear form 10 and progress to the nip of assembly 140.

Since laser printer 5 will normally have a feed path whose width is limited to conventional paper size (e.g. approximately 8½) envelope form 10, when fed through printer 5 is fed with flaps 16 folded into the closed position. Accordingly, an opening mechanism 148 is provided along path 130 to open flaps 16 before form 10 is accumulated with the following sheets.

Because form 10, with flaps 16 opened, is substantially wider than the sheets lateral guides G5 are provided to assure that the sheets are centered with form 10.

If two-thirds sheets, one-third sheets, or BRE's are fed from trays T3 or T4 along guides 120 gate G4 is activated and these sheets are diverted to guides 144. The diverted sheets are urged by urge rollers 146 and 148 into the nip of assembly 140 and are accumulated in the manner described above in the nip of assembly 140 with the previously processed envelope form 10, any printed sheets, and any pre-printed three-thirds sheets. Guides 144 include relief 152 for one-thirds pre-printed sheets and BRE's and relief 154 for two-thirds pre-printed sheets.

After all sheets are accumulated with form 10, motor M2, which drives accumulator folder assembly 140, is started and drives the completed accumulation into buckle chute 160 so that the completed accumulation is folded about fold line 24 between upper panel 12 and lower panel 20 of form 10. As the folded accumulation exits from assembly 140 it is captured by roller pair 178 and carried into flap folder sealer assembly 180. There adhesive A is moistened by moistener 182, side flaps 16 are closed by closing mechanism 184 and tailing flap 14 is closed, and all flaps are sealed by roller assembly 186. At this point form 10 and the accumulated sheets have been formed into a sealed mail piece. The sealed mail piece than is transported by transport 192 and exits folder sealer 6.

As sheets are driven into the nips of assemblies 106 and 140 with motors M1 and M2 not operating, any slight skew of the sheets with respect to the path of travel will be corrected as the leading edge of the sheets (or envelope form) are driven into the stationary nip. However, if the skew of the sheets is too great the leading corner may bind in the nip preventing correction of the skew. To avoid this it may prove desirable to briefly operate motors M1 and M2 in a reverse direction to allow the leading edges of the sheets to align themselves parallel to the nips as they are driven against them. Also, once the sheets are properly aligned motors M1 and M2 are "jogged" briefly to securely capture the sheets in the nips prior to folding.

As will be described below appropriate velocity profiles for motors M1 and M2 are readily achieved since motors M1 and M2 are preferably stepper motors having readily controllable velocity profiles.

Figure 4:
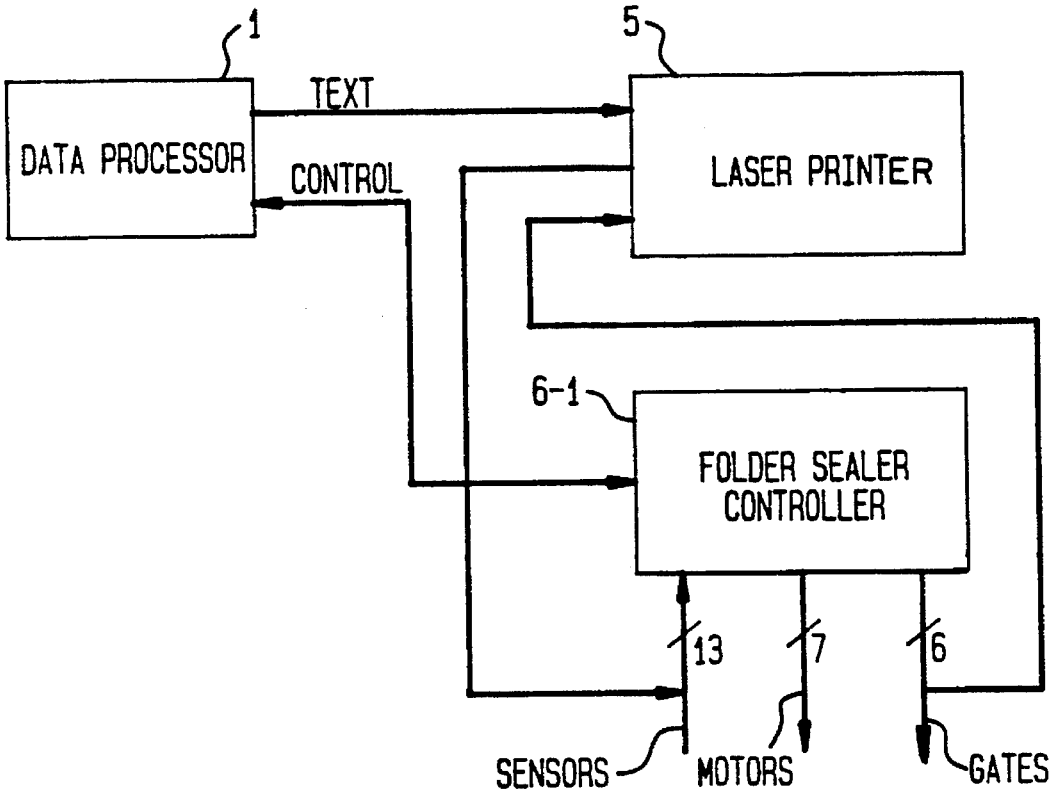
FIG. 4 shows a schematic block diagram of the flow of control and text information signals in the apparatus of FIG. 1.

Turning to FIG. 4 the control architecture for the system of the subject invention is shown. As described above data processor 1 controls laser printer 5 through a parallel interface in a conventional manner to print text. Folder sealer 6 is controlled through a conventional serial communications port, such as an RS232 port. Folder sealer 6 is controlled by controller 6-1 which includes an integrated circuit microcontroller, which is preferably a model 80C196KB manufactured by the Intel Corporation of California. As will be described below controller 6-1 receives data structures defining the configuration for mail pieces in a given mail run, from data processor 1, as well as specific information for each mail piece, such as ID numbers and variable numbers of printed sheets to be included in the mail piece. Controller 6-1 then controls devices, (i.e. sensors, motors, and gates) in folder sealer 6 to produce mail pieces in accordance with the data structures and specific mail piece information. As can be seen in FIG. 4, minor modifications, easily within the skill in the art have been made to laser printer 5 to allow controller 6-1 to read sensors provided in laser printer 5 and control a gate which is also part of laser printer 5.

Figure 5:
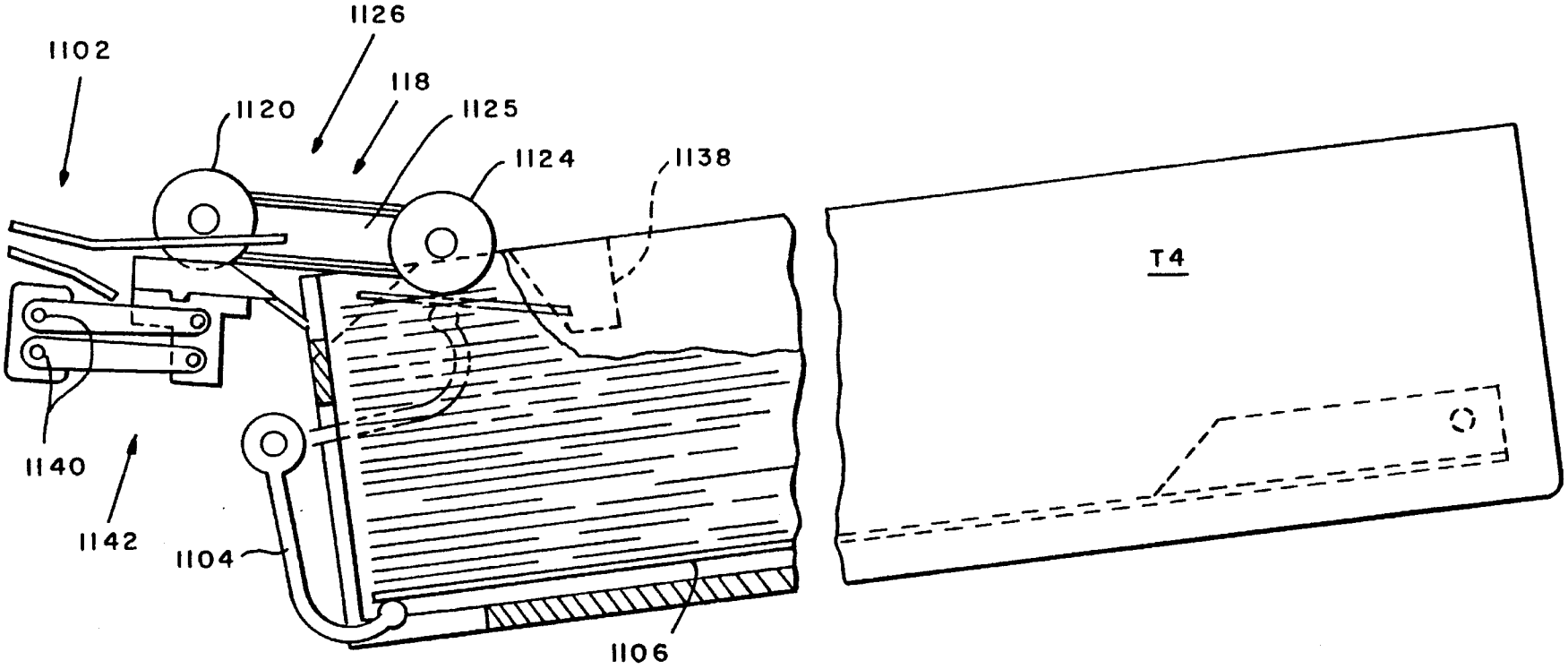
FIG. 5 is a cross section view, partly broken away, of a sheet feeder in accordance with the subject invention.
Figure 6:
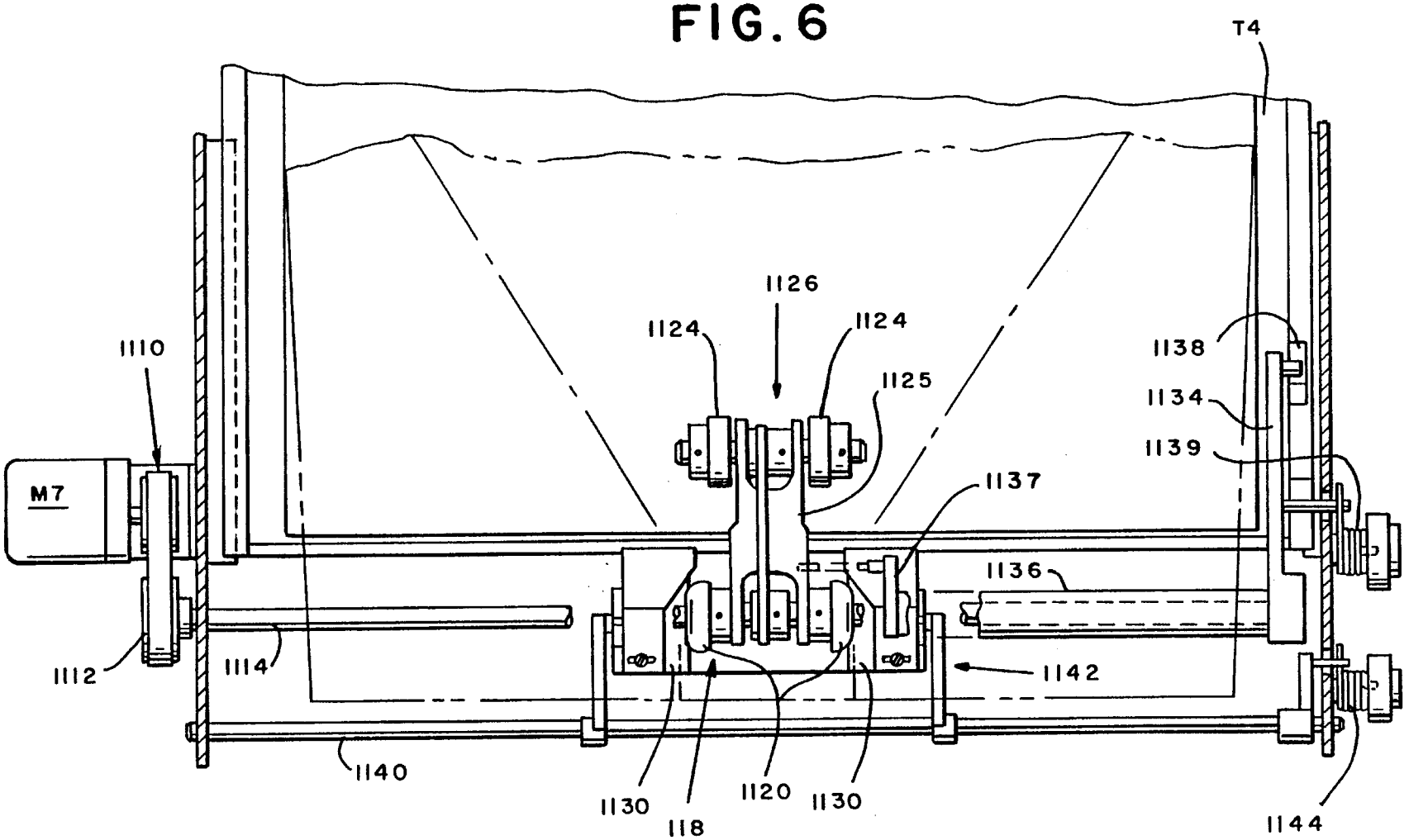
FIG. 6 is a top view, partly broken away, of the sheet feeder of FIG. 5.

FIGS. 5 and 6 show the sheet feeder used with tray T4. A substantially identical sheet feeder is used with tray T3, the only differences being those which result from the fact that tray T4 is made substantially deeper to allow feeding of a sufficient number of BRE's, which of course are substantially thicker than single sheets. As noted, either tray T3 or T4 may be used to provide pre-printed sheets of one-thirds, two-thirds, or three-thirds length. Conventional adjustable paper guides are provided within tray T3 and T4 for this purpose.

The sheet feeder also includes a corrugating feeder mechanism 118, which will be described more fully below, which outputs sheets to guides 1102 for further processing. To maintain contact between assembly 118 and the top sheet in tray T4 lever arm 1104 elevates pan 1106 as the number of sheets in tray T4 is reduced. Pan 1106 is hinged to tray T4 at its outboard end. Lever arm 1104 is activated by a separate motor (not shown) and controlled by a conventional sensor (not shown), such as a hall effect sensor, which senses the level of sheets in tray T4. As is known in the art, as the level of sheets in tray T4 drops below a pre-determined level lever 1104 is activated to raise pan 1106 to maintain contact between the top sheet and feeder mechanism 118. Preferably an out of paper condition may be detected by determining when lever arm 1104 has reach the upper extent of its travel.

To facilitate feeding of the top sheet trays T3 and T4 will make minimal contact with the top sheets. Preferably the rear wall of the trays angles backwards to avoid bearing on the sheets as the pan rotates upwards, and the only depth gage for filling the trays is a ledge at the far back of the tray so that restrictions on corrugating the top sheet are minimized.

Feeder mechanism 118 is activated by motor M7 (shown in FIG. 6) through belt and pulley assembly 1110, and shaft 1114.

Feeder mechanism 118 includes a pair of crowned corrugating feed rollers 1120 and a pair of low force feed rollers 1124. Rollers 1120 are fixed to shaft 1114 and rollers 1124 are mounted parallel to shaft 1114 and inboard of rollers 1120 in a position where they rest upon the top sheet of the stack of sheets in tray T4. The inboard (narrower spacing) of rollers 1124 with respect to rollers 1120 allows the top sheet to corrugate more easily as will be described more fully below. Rollers 1124 are mounted on arm 1125 which pivots about shaft 1114 to allow rollers 1124 to follow the level of sheets in tray T4. Rollers 1124 are driven from shaft 1114 by belt and pulley assembly 1126.

Rollers 1124 urge the top sheet in tray T4 forward until they are engaged by corrugating rollers 1120 which operate with quarter-round retarding elements 1130 to singulate the top sheet from any next sheet which may be carried along with the top sheet, as will be described more fully below.

To facilitate insertion of tray T4 lever arm 1134 (shown in FIG. 6) is deflected as tray T4 is inserted and rotates concentric torque tube 1136, which, in turn, rotates crank 1137 to raise arm 1125 and rollers 1124 upwards to clear tray T4. When tray T4 is fully inserted lever 1134 drops into relief 1138 allowing rollers 1124 to rotate downward onto the top sheet. A torque from spring 1139 may also be applied to rollers 1124 through lever 1134 and torque tube 1136 to adjust the force with which rollers 1124 bears on the top sheet to limit the frictional forces developed between the top and next sheets while generating sufficient friction force to pick-up the top sheet. Stops 1141 (shown in FIG. 7) are also provided to limit the travel of four bar linkage 1142 and prevent elements 1130 from touching feed rollers 1120 when no sheet is present.

As will be described more fully below retarding elements 1130 are mounted on fixed, parallel shafts 1140 (best seen in FIG. 7) through a four bar linkage 1142 which is spring biased upwards by spring 1144 against stops 1141 to maintain a clearance approximately equal to the thickness for the thinnest sheets to be fed between retarding elements 1130 and corrugating rollers 1120. Four bar linkage 1142 allows retarding surfaces 1130 to deflect downward while retaining the correct orientation when thick sheets are fed from tray T4. Thus, feeder 118 can be used to feed thicker sheets which might otherwise resist corrugation and jam. This is a particular advantage of the subject invention in that it is believed that feeder 118 will also feed items such as prefolded inserts and booklets and the like.

Figure 7:
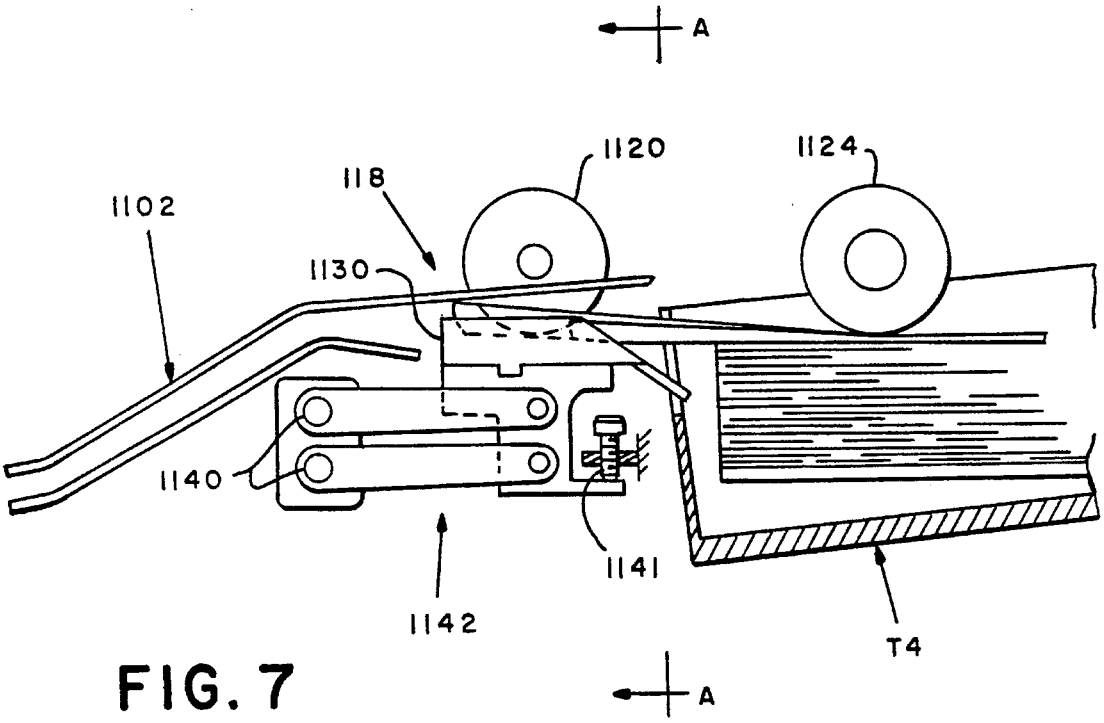
FIG. 7 is a front plan view of corrugating feed rollers and retarding elements used in the subject invention.
Figure 8:
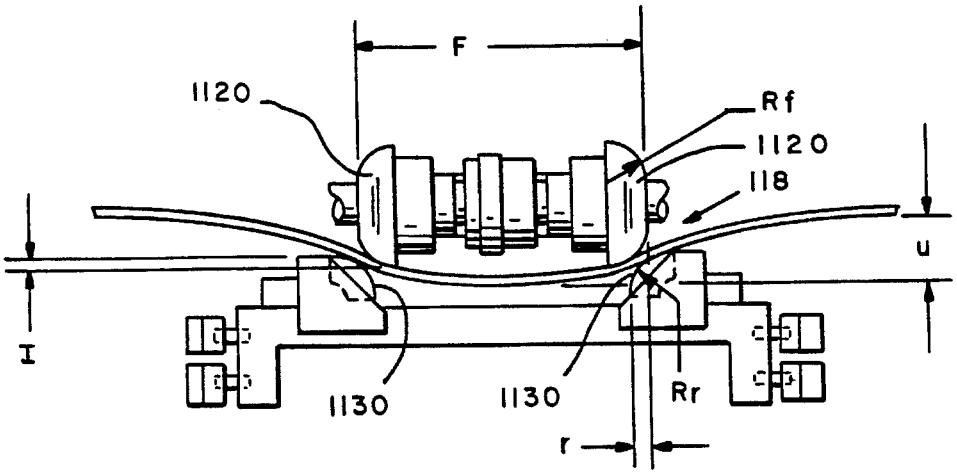
FIG. 8 is a side view along line A—A of FIG. 7.

FIGS. 7 and 8 show the operation of corrugating feed rollers 1120 and retarding elements 1130 in singulating a top sheet from the next sheet. As the top sheet is urged into contact with rollers 1120 it is depressed downwards and outwards and fed forwards between quarter-round retarding elements 1130 causing an upwards corrugation of the top sheet away from the next sheet, as shown in FIG. 8. This bowing, or corrugation, reduces the drag forces due to fiction and/or static electricity between the top sheet and the next sheet, greatly facilitating singulation of the top sheet and stiffens the sheet in the feed direction, to improve feeding. Rollers 1120 are preferably formed of a high coefficient of friction material such as polyurethane so that rollers 1120 can drag the top sheet across fixed retarding elements 1130. Elements 1130 are also preferably formed of materials such as polyurethane.

Retarding elements 1130 develope a sliding friction force sufficient to retard any sheet attached to the top sheet. When elements 1130 bear directly on the top sheet the frictional force developed is designed to be less than the static friction of rollers 1120 and will not cause rollers 1120 to slip on a top sheet.

As noted above, and as best seen in FIG. 7, four bar linkage 1142 allows retarding elements 1130 to deflect downward when a thick sheet, such as a BRE is fed. By deflecting retarding elements 1130 downward the possibility of jams is reduced when sheets which are stiff enough to resist corrugation are fed. The force with which retarding elements bear upwards against stops 1141 or any interposed sheets is determined by a torque applied by spring 1144 (shown in FIG. 6) through shafts 1140.

As can best be seen in FIG. 7, the singulated top sheet is fed into guides 1102 which acts to smooth the corrugation from the leading edge of the sheet, allowing it to bend easily as it is fed, and which guides the singulated sheet to guides 120 for further processing. This smoothing or decorrugating action also improves the singulation between the top and next sheets as the smoothing action propagates backwards, tending to flatten the sheet between retarding surfaces 1130, thus increasing the force with which elements 1130 bear against the bottom of the sheet. Note that the extended structure of elements 1130 combined with the corrugating of the sheets allows the retard force to be applied over an extended area. This is as opposed to conventional retard feeders, where the retard is a plane or a cylinder, and where the retarding action must take place on the tangent line between that retard plane or cylinder and the feed rollers.

EXAMPLE

In the following example, which it is believed will perform satisfactorily with a range of commercially available sheet stock, BRE's and with envelope forms, reference is made to the following dimensions and parameters as shown in FIG. 8.

"F"—is the separation between corrugating feed rollers 1120. F will be chosen large with stiffer material and with increased distance which the sheet is fed by rollers 1120. For thin sheets fed a short distance F may be reduced to a value small enough that it becomes desirable to include both of the roller bearing surfaces in a single element, and as used herein, the term "pair of feed rollers" includes such a single element as a limiting case. F will be chosen larger with stiffer material and with increased distance which the sheet is fed by rollers 1120. "r"—is the horizontal separation between rollers 1120 and retarding elements 1130. The smaller r is selected the tighter the sheet must bend. "I"—is the vertical interference between rollers 1120 and retarding elements 1130. The greater I is chosen the tighter the sheet must bend. "$R_f$", "$R_r$"—are radii of rollers 1120 and retard elements 1130, are chosen the tighter the sheet must bend.

"$f_f$", "$f_r$"—are the coefficients of friction of rollers 1120 and retarding elements 1130 respectively.

In general selection of particular values is guided by the relationship of the degree of corrugation (i.e. tightness with which the sheet is bent) to the separation efficiency, which increases, and the force need to feed a sheet, which also increases.

The following specific values are believed to provide satisfactory performance:

F=1.75 inches r=0.125 inches (horizontal overlap)

I=0.125 inches $R_f$=0.250 inches $R_r$=0.200 inches $f_f$=2.0

$f_r$=1.0

Those skilled in the art will recognize that numerous other embodiments may be derived from the above descriptions, drawings and examples. Accordingly limitations on the subject invention are to be found only in the claims set forth below.

What is claimed is:

1. A mechansim for feeding sheets from a stack, comprising:

a) take-up means for urging the top sheet of said stack forwards; and, b) combined means for receiving said top sheet, separating said top sheet from a following sheet which may adhered to said to sheet, and feeding said top sheet forward for further processing, said combined means further comprising:

b1) a pair of, spaced retarding elements extending parallel to, and longitudinally and rotationally fixed with respect to, the direction of motion of said top sheet and positioned to bear against the bottom surface of said following sheet;

b2) a pair of feed rollers positioned above and between said retarding elements, and positioned with a predetermined vertical interference with respect to said retarding elements, and with a clearance with respect to said retarding elements approximately equal to the thickness of the thinnest sheet to be fed by said mechanism, wherein facing surfaces of said retarding elements have a convex curvature and the surfaces of said feed rollers proximate to said facing surfaces have a convex surface, and said feed rollers are positioned with a predetermined horizontal overlap with respect to said retarding elements.

2. A mechanism as described in claim 1 wherein said retarding elements are spring biased against stops to control the force applied by said retarding elements.

3. A mechanism as described in claim 2 wherein said retarding elements are mounted on a four bar linkage for allowing said retarding elements to be displaced downwards while maintaining a constant orientation with respect to said feed rollers, whereby sheets of varying thickness, may be fed without jamming said mechanism.

4. A mechanism as described in claim 1 wherein said take-up means further comprises a take-up feed roller positioned rearwards of said feed rollers and bearing on the top sheet of said stack.

5. A mechanism as described in claim 4 wherein said take-up feed roller is mounted on a pivotable arm extending rearwards from said feed rollers, whereby said feed roller rotates to remain in contact with the top sheet of said stack as sheets are fed from said stack.

6. A mechanism as described in claim 1 further comprising means for decorrugating said top sheet said decorrugating means comprising a fixed, substantially flat plate.

* * * * *